US005836199A

United States Patent [19]

Loud

[11] Patent Number: 5,836,199

[45] Date of Patent: Nov. 17, 1998

[54] BEADED SHAFT ASSEMBLY

[75] Inventor: Christopher R. Loud, Issaquah, Wash.

[73] Assignee: Zetec, Inc, Issaquah, Wash.

[21] Appl. No.: 759,408

[22] Filed: Dec. 4, 1996

[51] Int. Cl.[6] ..... B21D 9/03

[52] U.S. Cl. ..... 72/466; 72/478; 59/78.1

[58] Field of Search ..... 72/466, 478; 59/2, 59/78, 78.1, 95

[56] References Cited

U.S. PATENT DOCUMENTS

| | | | |
|---|---|---|---|
| 1,016,770 | 2/1912 | Persons | 72/466 |
| 1,978,452 | 10/1934 | Flodin | 72/466 |
| 2,425,298 | 8/1947 | Attridge et al. | 72/466 |
| 2,962,077 | 11/1960 | Condiff | 72/466 |
| 4,671,096 | 6/1987 | Crosby, Jr. | 72/466 |

FOREIGN PATENT DOCUMENTS

| | | | |
|---|---|---|---|
| 301205 | 4/1971 | U.S.S.R. | 72/466 |
| 580028 | 11/1977 | U.S.S.R. | 72/466 |

*Primary Examiner*—David Jones
*Attorney, Agent, or Firm*—David L. Tingey

[57] ABSTRACT

A plurality of beads with matching transverse faces and longitudinal bores cooperate to form a bendable shaft with a duct therethrough, held in face-to-face contact with a plurality of elastic bands within the duct. Alternatively, the plurality of bands may comprise a single elastic inner tube. The elastic bands may also mutually overlap to provide redundancy in case a band should break.

15 Claims, 4 Drawing Sheets

BEADED SHAFT ASSEMBLY

BACKGROUND

1. Field of the Invention

This invention relates to positioning shafts for probe assemblies and, specifically, to a flexible beaded shaft with an attached probe used in inspection of the interior of longitudinally-curved tubular members and passageways.

2. Prior Art

It is known in the art to have remote sensors, or probes, attached to the lead end of a flexible shaft. Such shaft with probe is useful for remotely obtaining nondestructive measurements of the integrity of tubular members and passageways common, for example, in nuclear steam generators that include a number of curved tubes. Such curved tubes include U-shaped tubes found in heat exchangers. Primary fluid is circulated between the nuclear reactor where it is heated and the steam generator where its heat is transferred to feed water, converting it to steam. It is imperative that the tubes carrying the two fluids be maintained free of defects so the radioactive primary fluid does not contaminate the feed water.

Generally, in monitoring the integrity of tubular conduits remotely so personnel are not exposed to possible radiation, a testing probe is delivered internal the conduits by means of a positioning shaft to which it is attached. As the shaft impels the probe into the conduit, the probe measures the host conduit along its length, or longitudinally, transmitting probe measurement data out of the conduit through cables carried in a duct within the shaft. Clearly, the duct is suitable for a number of other communication means, such as electrical conductors, signal wires, hydraulic and pneumatic lines, strain wires, instrumentation leads, mechanical actuators, or piping for fluid or material delivery.

Because the nuclear industry heat exchanger tubes have a tight bend radius, typically less than 2 inches, it has always been extremely difficult to inspect them because of the inflexibility of conventional shaft materials and the lack of a sufficient mechanical advantage that would enable a conventional probe shaft to withstand forces encountered in attempting to urge a probe around these tight radii. Without the capability of negotiating the tight-radii bends, it becomes impossible to perform a full-length examination of the tubes, that is, from one tube end to another. This results in increased inspection time, increased exposure to personnel setting up the measurement equipment, and increased damage to measurement equipment.

U.S. Pat. No. 5,174,164 issued to Wilheim is illustrative of a flexible shaft for positioning an eddy current probe within a tube of a nuclear reactor and describes many of the difficulties encountered in nondestructive testing of such tubes. Wilheim discloses a shaft central core, typically of helically-wound layered steel to which a sensor probe is attached at its distal end. About the central core is a plurality of successive interconnecting "tulip-shaped" beads cooperating as a ball in socket. In operation, as the shaft is urged around a tube turn, a bead ball rotates in a successive bead socket. In such an arrangement, the core and probe can be stationary relative to the beads which support the shaft in the tube, allowing the beads to rotate while the shaft remains stationary. It appears, however, that the shaft does not provide a means for absorbing compressive forces along the shaft as it is urged through a tube by a driver at its proximal end (near the tube end). Neither does it appear to allow a tight bending of the shaft while absorbing said compressive forces.

U.S. Pat. No. 5,174,164 issued to Timm also discloses a flexible shaft supporting a sensor. Timm includes a helically-coiled support member over which a plurality of spaced-apart bushing retainers are secured, the support stretched to bias it into coil-to-coil contact. It appears, again, that the shaft does not provide a means for absorbing compressive forces along the shaft to resist buckling of the shaft in the tube while simultaneously allowing for tight bending an a tube.

SUMMARY OF THE INVENTION

It is the object of the present invention to provide a flexible shaft to which a probe may be attached for delivering the probe along a tube with tight bends as commonly used in nuclear reactors without buckling or damaging the probe or shaft as the shaft is driven from its proximal end into the tube. It is a further objective that the shaft be mechanically uncomplicated. It is another objective that the shaft absorb compressive forces incurred as the shaft is impelled into the tube without buckling while still negotiating tight bends, even in tubes of less than 2-inch inner diameter. It is a still further objective that the shaft comprise an inner duct shielded by shaft members to protect the inner duct from an adverse external environment. It is a final objective that the shaft be biased to a straight rest position yet facilly yield to a sharp bend with the bias tending to return the shaft to its rest position.

This objective is achieved in a plurality of beads with transverse faces for transmitting and absorbing compressive forces from impulsion of the shaft through a tube. The beads have the same outside diameter, typically about 0.5-inches. Beads include a longitudinal bore and are aligned end to end to form a shaft chain with an axial duct. A probe is attached to a bead at the shaft distal end.

The beads are held together in face to face contact. The beads are not interconnected to avoid a tendency to break at such an interconnection, but are held in face to face contact by at least one elastic band stretched between the shaft distal and proximal ends. Multiple bands provide redundancy to assure shaft removability in the instance of a band break. With at least 2 opposing bands, preferably at least 3, the beaded shaft is biased in a straight position. The longitudinal bands serve to oppose buckling and even bias the shaft out of a buckling condition should it occur. The flexible elastic band also allows intrusion of a bead into the duct without damaging the band, the band simple stretching to temporarily accommodate the intruding bead.

In an alternative embodiment, the multiple bands may comprise a single elastic inner tube, perhaps of approximately 0.05 inches, supple, flexible and smooth on both its inner and outer surfaces, elastic, and thermally stable put to about 200 degrees Fahrenheit. In assembly, the alternating bead types are inserted over the inner tube. The inner tube is then pretensioned by securing one end of the inner tube to one chain end and stretching the inner tube towards the other chain end where it is secured. Selective beads may also be secured to the inner tube along the chain, for example by set screws passing through threaded holes in the beads and into the inner tube. Clearly, other securing means may be employed with equivalent result, such as capture rings, clamping collars, pins, welds, and adhesives. Upon releasing the pretensioned inner tube, its elasticity urges the beads over the inner tube to be compressed tightly together.

Because the beads are biased tightly together with matching spherical transverse faces, they cooperate in the chain as a bendable solid shaft transferring a pushing or pulling force axially toward as the shaft is being urged into or out of a tube or passageway. The beads having stout cross-sectional geometry affords great resistance to being crushed, crumpled, cracked, or broken when high tension or compression is applied by a chain driver.

To allow compressive forces to be transmitted through transverse bead faces even when the shaft is bending, adjacent bead transverse faces are matching positive and negative spherical segments, respectively, truncated upon interface with the duct, such that a positive face swivels in a negative face while maintaining substantial mutual contact face-to-face disposed to transmit longitudinal forces along the shaft during a bend.

The beads are made of a lubric material, such as nylon or delrin, with mechanical properties such that impulsion forces can be transmitted between beads along the chain yet still facilitate sliding ease between adjacent bead matching faces and in a tube.

The large face-to-face interface between beads held in compression also provides an environmental shield against adverse conditions. In addition, when an inner tube is employed, the tube also provides an further environmental shield.

DETAILED DESCRIPTION OF THE PREFERRED EMBODIMENTS

Figure 1:
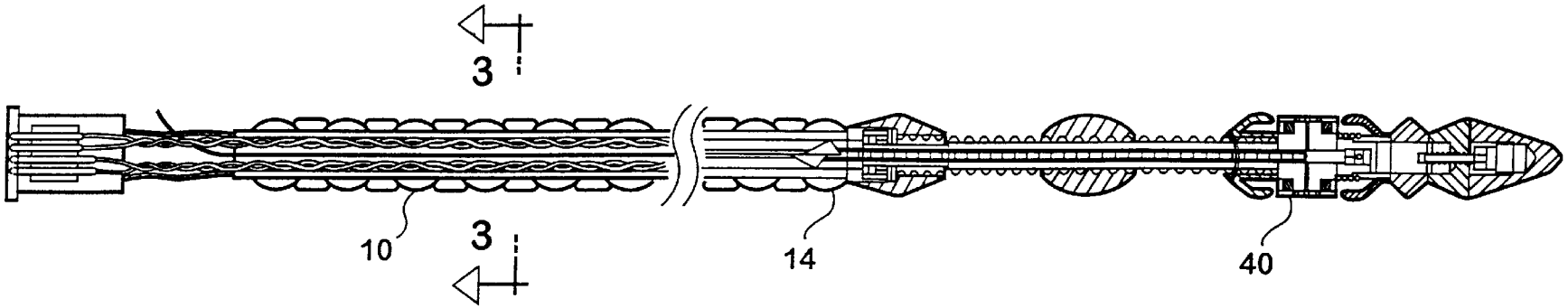
FIG. 1 is a longitudinal cross-sectional view of a combination of a probe attached to a beaded shaft.

The flexible shaft of the present invention comprises a plurality of self-supporting adjoining beads 10 in a chain with a chain axis 11 with first and second bead ends 12,13 in line with the chain. A measurement probe 40 may be attached in combination at the cable distal end 14 for leading the cable into a tube 100. A drive mechanism 50 is attached at the cable proximal end 15 for impelling the shaft into the tube 100. For these purposes, cable distal end 14 is meant to describe the cable end first entering the tube 100, and the cable proximal end 15 is meant to describe the cable end 14 opposite the distal end and nearest the tube end in which the cable enters when the cable is in the tube.

First and second longitudinal beads ends 12,13 in line with the chain, have a transverse contact face 16 of substantial cross-section sufficient for transmitting impulsion forces through the chain. The beads are disposed in a chain with contact faces of adjacent beads matching. Each bead 10 has a longitudinal bore 17 which when assembled into a chain collectively forms a chain duct 20 along the chain axis through which at least one cable 101 may be carried for providing communication between the sensor and the cable distal end.

The beads 10 are maintained together at their contact faces 16 swivelly by means of at least one elastic band 18 within the duct 20 attached to and stretched between the beads, thus compressing the beads together. A band may be attached between a selective first pair of beads 21 and a second band may be attached between a second pair of beads 22 overlapping the first band, thus providing redundancy which maintains the integrity of the chain in the instance of a band breaking during use, thus allowing the chain to be extracted from a tube in such instance. The band may also attach between cable distal and proximal ends. To provide desired redundancy, additional bands may be employed between the ends. When a plurality of bands are about the chain duct circumference, the chain is biased into a straight position. Thus, when the chain is bent as when it follows the direction of tube in which it is inserted, the chain tends to self-straighten when the tube straightens. The elastic bands may collectively comprise an elastic tube stretched between the cable distal and second beads.

The chain is clearly modular with the assembly of a chosen number of beads. The chain length is then conveniently modified by simply adding or subtracting the number of beads comprising the chain. In doing so, the elastic band or bands are released at one chain end over which a bead is added or removed before reattaching the bands to the remaining chain of beads, forming the shaft of changed length. Each band may be attached to a selective bead by any number of suitable means, such as attachment rings to which bands are attached or band hooks or heads engaging a bead end or groove.

Figure 4:
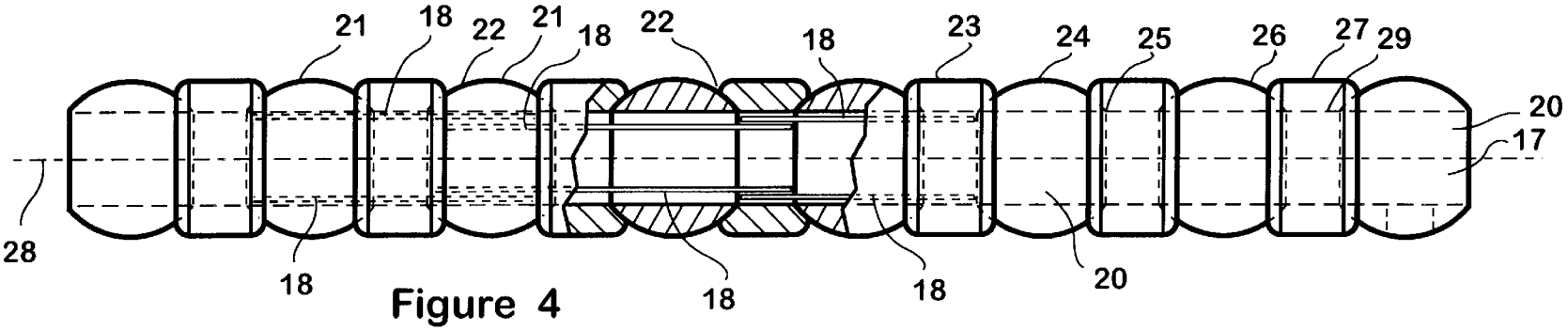
FIG. 4 is a side view of a beaded shaft comprising alternating spherical and cylindrical beads with aligned bores.

In a first embodiment as shown in FIG. 4, the cable comprises alternating first and second type beads 23 and 24 with the first type bead 23 including a spherical segment recess 25 and the adjacent second type bead 24 including a convex spherical round 26 matching and moving freely in the first type bead recess 25, swivelly, while maintaining face-to-face contact with the recess to facility transfer of impulsion forces through the chain without buckling. The first type bead 23 comprises a cylinder 21 with an axis and a longitudinal bore 29 therethrough with the spherical segment recess 25 at each end. The second type bead 24 with spherical segment recess 25 in fact comprises a sphere with a longitudinal bore therethrough the spherical round of the second type bead fits in the first type bead recess with the bores aligned to form the cylindrical duct 20 therethrough.

Figure 5:
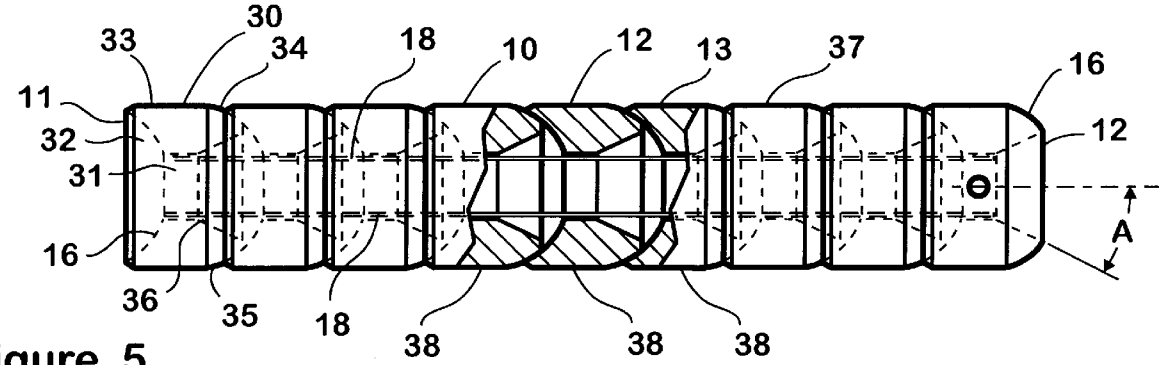
FIG. 5 is a side view of a beaded shaft comprising a series of cylindrical beads with aligned bores having a spherical segment on a first end matching a recess on a second end.

As shown in FIG. 5, in a second embodiment, the first and second type beads comprise a cylinder 30 with a longitudinal bore 31 therethrough with a spherical segment recess 32 at one end 33 and a matching convex spherical round 34 at its other end 35, with the spherical round of one bead inserted in face-to-face contact, swivelly, in the recess of an adjacent following bead. Preferably, the longitudinal bore expands in a frustum 36 at the spherical end such that the spherical round swivels in the recess to a limit angle, A, from a cylindrical bead axis, and the frustum expands from the longitudinal bore at an angle no less than the limit angle with the extrapolated frustum intersecting the bead axis at or within the spherical segment recess. Thus, by design the spherical round swivels in the recess without moving into the duct avoiding impact of the bead during a bend with objects carried within the duct.

Figure 6:
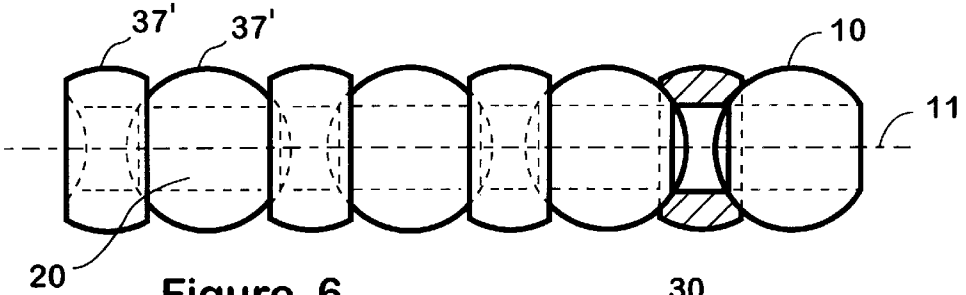
FIG. 6 is a side view of a beaded shaft comprising a series of alternating spherical beads with aligned bores, a first having spherical recesses on each end matching spherical curvature of a second.

Referring to FIG. 5, each bead 10 may further comprise a cylindrical outer surface 37 such that the beads in the chain collectively present a substantially continuous outer chain surface 38 disposed to uniformly distribute load stresses incurred in the chain when redirected by its impulsion along a curvilinear surface. Alternatively, to present a minimal bead outer surface contact on a surface on which the bead may rest as shown in FIG. 6, the bead outer surface 37 may be spherical such that each bead supports the chain on a portion of a circumferential line in a plane orthogonal to the chain axis. The bead outer surface may instead have an irregular outer surface 37' as shown in FIG. 7 for enhanced traction comprising beads of dissimilar outer surfaces.

Figure 7:
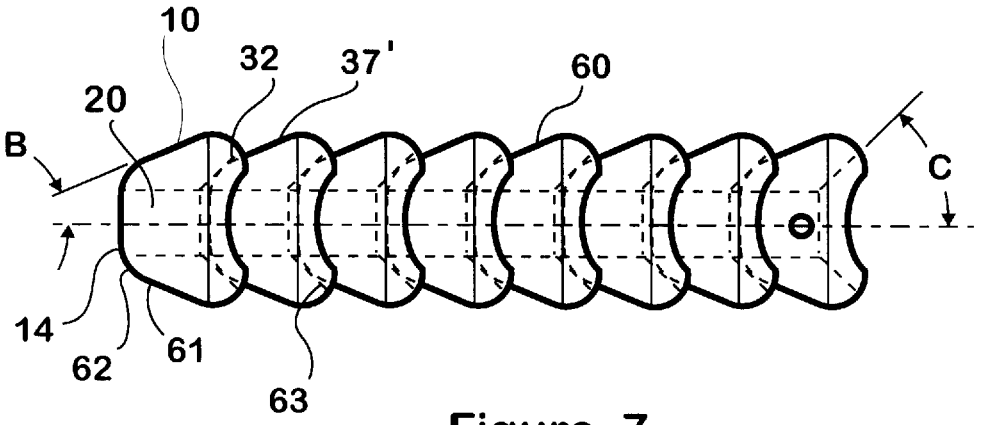
FIG. 7 is a side view of a beaded shaft comprising a series of similar beads having an outer surface slanted toward the shaft distal end and a first curvilinear end of a first bead positioned swivelly in a frustum recess of an adjacent bead.
Figure 8:
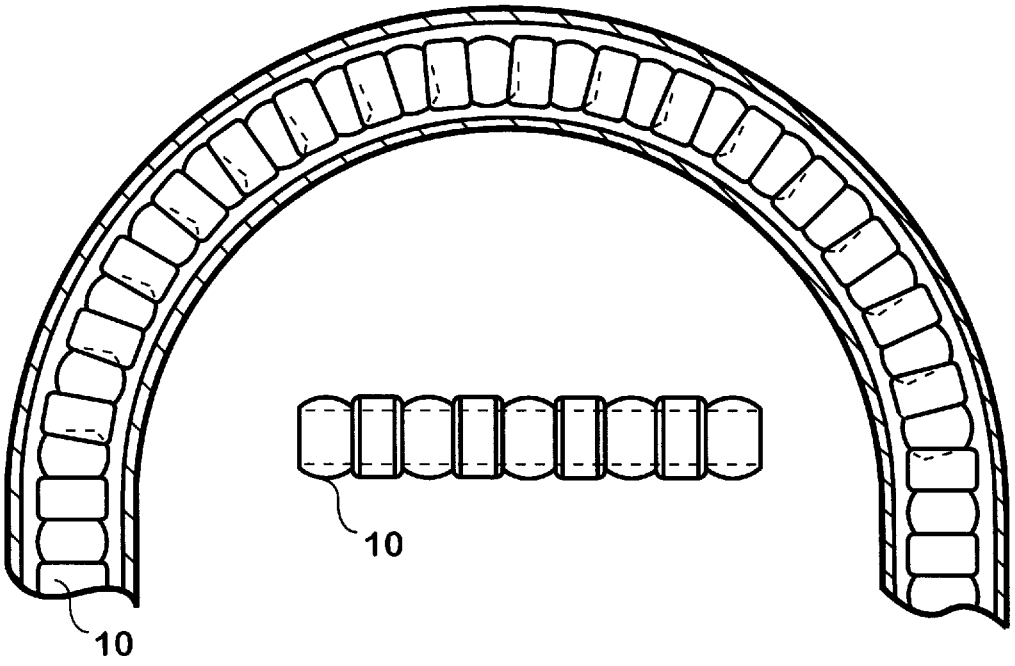
FIG. 8 is an illustration of a beaded shaft within a small-radius tube.

Still referring to FIG. 7 in a third alternative, the bead 10 may comprise an outer surface 60 tapered toward the bead spherical end 61 at a taper angle B toward the chain distal end to facilitate sliding over irregularities. The spherical end 61 then reduces to a round 62 between the tapered surface 60 and the bead bore 20. The spherical recess 32 then may be any curvature with radius greater than that of the round 62, even a frusto-conical recess surface 63 with cone angle C on which the round may swivel with the cone angle greater than the taper angle so the bead spherical end can swivel in the recess to a bend up to contact of the outer surface with the conical recess surface.

Figure 3:
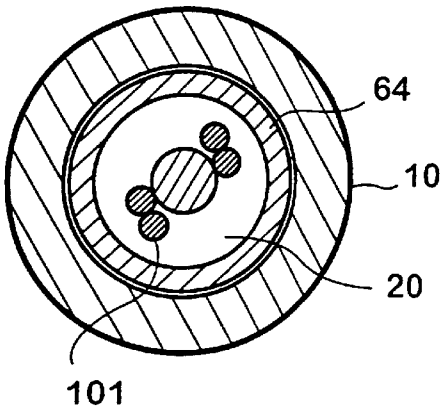
FIG. 3 is a transverse cross-sectional view of the beaded shaft.
Figure 2:
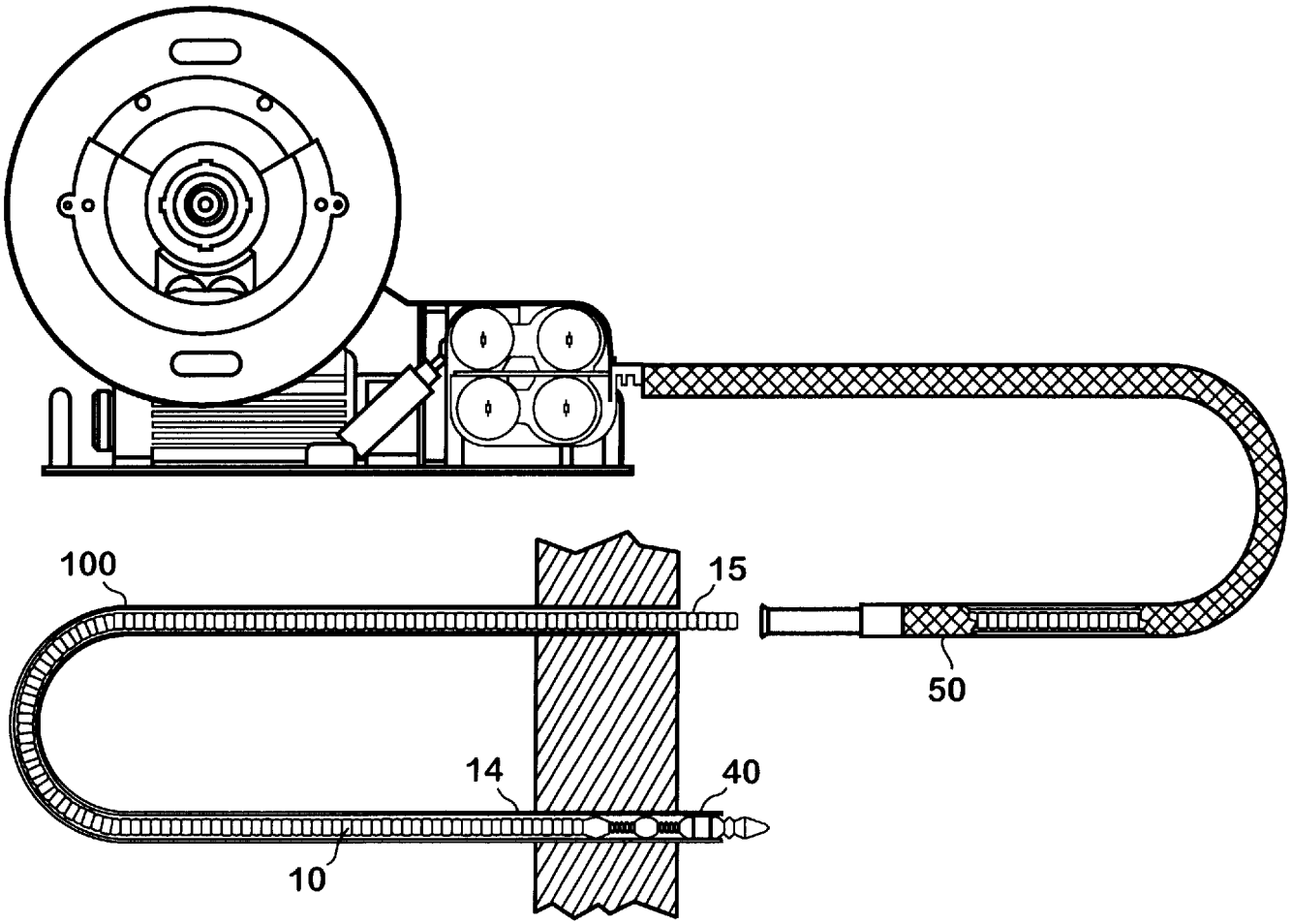
FIG. 2 is an illustration of the probe and shaft in a typical application within a curved tube.

The flexible shaft is intended to operate in a possible adverse environmental condition. It is therefore advantage to provide means for substantially shielding the duct through its length from such adverse external environments. One such means is to provide beads maintained in areally broad face-to-face contact, including during bending of the chain. Another means is to provide an elastic, tubular environment shield 64 within the duct shown in FIG. 3. The elastic band when comprising a single elastic tube may also serve as the shield.

Having described the invention, what is claimed is:

1. A flexible shaft with distal and proximal ends comprising, a self-supporting chain of adjoining beads with first and second bead ends in line with the chain, each end with a transverse contact face, the beads disposed in longitudinal adjacency on a chain axis, the contact faces of adjacent beads matching, and having a longitudinal bore which collectively form a duct along a chain axis means for maintaining the beads together swivelly in face to face contact comprising at least one elastic band within the duct attached to and stretched between beads, compressing the beads together, and in which a first band attaches between a first pair of beads and a second band attaches between a second pair of beads and overlaps the first band.

2. The flexible shaft of claim 1 further comprising means for substantially sealing the duct through its length shielding the duct from an adverse external environment.

3. The flexible shaft of claim 2 wherein the means for substantially sealing the duct through its length comprises closely-held beads with tranverse contact faces maintained in areally broad face-to-face contact during bending of the chain.

4. A flexible shaft with distal and proximal ends comprising, self-supporting chain of adjoining beads with first and second bead ends in line with the chain, each end with a transverse contact face, the beads disposed in longitudinal adjacency on a chain axis, the contact faces of adjacent beads matching, and having a longitudinal bore which collectively form a duct along a chain axis, means for maintaining the beads together swivelly in face to face contact comprising at least one elastic band within the duct attached to and stretched between beads, compressing the beads together, in which the elastic band attaches to beads at shaft distal and proximal ends and collectively comprises a closed elastic tube stretched between the cable distal and proximal ends.

5. The flexible shaft of claim 4 further comprising alternating first and second type beads with the first type bead including a spherical segment recess and the adjacent second type bead including a convex spherical round matching and moving freely in the first type bead recess, swivelly, while maintaining face-to-face contact with the recess to facilitate transfer of impulsion forces through the chain without buckling.

6. The flexible shaft of claim 5 wherein the first type bead comprises a cylinder with an axis and longitudinal bore therethrough and with a spherical segment recess at each end, and the second type bead comprises a sphere with a longitudinal bore therethrough with a said second type bead in each first type bead recess with the bores aligned to form the cylindrical duct therethrough.

7. The flexible shaft of claim 5 wherein first and second type beads are similar in that each comprises a cylinder with a longitudinal bore therethrough with a spherical segment recess at one end and a matching convex spherical round at its other end, with the spherical round of one bead inserted in face-to-face contact, swivelly, in the recess of an adjacent following bead.

8. The flexible shaft of claim 7 wherein the longitudinal bore expands in a frustum at the spherical end such that the spherical round swivels in the recess without moving into the duct.

9. The flexible shaft of claim 8 wherein the spherical round swivels in the recess to a limit angle from a cylindrical bead axis and the frustum expands from the longitudinal bore at an angle no less than the limit angle with the extrapolated frustum intersecting the bead axis at or within the spherical segment recess.

10. The flexible shaft of claim 7 wherein each bead further comprises a cylindrical outer surface such that the beads in the chain collectively present a substantially continuous outer chain surface disposed to uniformly distribute load stresses incurred in the chain when redirected by its impulsion along a curvilinear surface.

11. The flexible shaft of claim 7 in which the bead further comprises an outer surface tapered toward the bead spherical end at a taper angle.

12. The flexible shaft of claim 11 in which the spherical end comprises a round between the tapered surface and the longitudinal bore and the spherical recess comprises a curvature with radius greater than that of the round.

13. The flexible shaft of claim 12 in which the recess curvature comprises a frusto-conical recess with a cone angle on which the round may swivel with the cone angle greater than the taper angle.

14. The flexible shaft of claim 5 in which each bead has an outer spherical surface such that each bead supports the chain on a portion of a circumferential line in a plane orthogonal to the chain axis, presenting minimal bead outer surface contact on a surface on which it may rest.

15. The flexible shaft of claim 5 in which the chain of beads has an irregular outer surface for enhanced traction comprising beads of dissimilar outer surfaces.

* * * * *